US011779107B1

(12) United States Patent
Hernandez

(10) Patent No.: US 11,779,107 B1
(45) Date of Patent: Oct. 10, 2023

(54) MOVABLE DESK WITH ADJUSTABLE LIFT AND TILT

(71) Applicant: Victor Hugo Hernandez, Huntington Beach, CA (US)

(72) Inventor: Victor Hugo Hernandez, Huntington Beach, CA (US)

( * ) Notice: Subject to any disclaimer, the term of this patent is extended or adjusted under 35 U.S.C. 154(b) by 0 days.

(21) Appl. No.: 18/080,220

(22) Filed: Dec. 13, 2022

(51) Int. Cl.
*A47B 13/08* (2006.01)
*A47B 9/00* (2006.01)
*A47B 5/06* (2006.01)
*A47B 21/02* (2006.01)

(52) U.S. Cl.
CPC ..... *A47B 13/081* (2013.01); *A47B 5/06* (2013.01); *A47B 9/00* (2013.01); *A47B 21/02* (2013.01)

(58) Field of Classification Search
CPC ..... A47B 13/081; A47B 5/06; A47B 9/00; A47B 9/02; A47B 21/02; A47B 2200/0042
USPC ..... 108/2, 6, 7, 11, 10, 50.01
See application file for complete search history.

(56) References Cited

U.S. PATENT DOCUMENTS 356,023 A * 1/1887 Aston ..... A47B 23/046 108/8
1,652,774 A * 12/1927 Fraser ..... A47B 19/06 108/1
1,770,955 A * 7/1930 Storm ..... A47B 23/00 108/8
2,240,395 A * 4/1941 Evans ..... A47B 13/081 108/130
2,545,515 A * 3/1951 Mast ..... A47B 9/00 108/138
3,079,726 A * 3/1963 May ..... A47B 27/08 108/106
3,184,207 A * 5/1965 Hermanns ..... D05B 75/02 248/413
3,213,809 A * 10/1965 Kritske ..... A47B 27/18 248/404
3,557,791 A * 1/1971 Duffy ..... A61B 90/60 606/1
4,248,161 A * 2/1981 Adair ..... A47B 27/02 D6/656.11
4,681,042 A * 7/1987 Roberts ..... A47B 27/18 108/6
4,790,611 A 12/1988 Craner
4,938,153 A * 7/1990 Maes ..... A47B 23/046 108/6
4,947,763 A * 8/1990 Piorek ..... F16M 11/24 108/147.19
5,044,284 A * 9/1991 Gross ..... A47B 21/0314 248/242
5,138,955 A * 8/1992 Manner ..... A47B 17/02 108/1
5,174,223 A * 12/1992 Nagy ..... A47B 83/001 108/50.01
5,287,815 A * 2/1994 Gross ..... A47B 21/02 108/50.01

(Continued)

*Primary Examiner* — Jose V Chen
(74) *Attorney, Agent, or Firm* — University of San Francisco School of Law; Alyssa L. Vallero; Nathan D. Banks

(57) ABSTRACT

An electrically lifted and titled computer desk and office desk thereof, wherein the computer desk comprises a desktop, a first and second tilt plate coupled to the vertical members, wherein the actuator driving mechanism drives the desktop to tilt and/or raise simultaneously.

17 Claims, 14 Drawing Sheets

(56) References Cited

U.S. PATENT DOCUMENTS 5,483,902 A * 1/1996 Grosch ..... A47B 21/02 108/143
5,577,806 A * 11/1996 Ugalde ..... A47C 16/025 248/397
5,685,231 A * 11/1997 Eyre ..... A47B 21/0314 108/7
5,778,799 A * 7/1998 Eyre ..... A47B 21/0314 108/50.01
6,038,986 A * 3/2000 Ransil ..... A47B 9/02 108/146
6,055,912 A * 5/2000 Doud ..... A47B 17/003 248/250
6,701,851 B2 * 3/2004 Ibrahim ..... A47B 21/0314 108/50.01
7,594,475 B1 * 9/2009 Huang ..... A47B 9/16 297/423.46
8,065,966 B1 * 11/2011 Bacon ..... A47B 9/16 108/147
8,789,474 B2 * 7/2014 Kim ..... A47B 41/02 108/50.01
8,800,454 B2 8/2014 Jones
8,826,831 B2 9/2014 Hazzard et al.
9,232,855 B2 1/2016 Ergun et al.
9,366,379 B2 6/2016 Bowman et al.
9,820,565 B2 11/2017 Zebarjad et al.
9,961,990 B2 5/2018 Benden
10,123,613 B2 11/2018 Hall et al.
10,485,336 B1 11/2019 Laudadio et al.
11,006,744 B2 5/2021 Benden
11,470,959 B1 10/2022 Poniatowski
2007/0266912 A1 * 11/2007 Swain ..... A47B 9/02 108/145
2015/0216296 A1 8/2015 Mitchell
2015/0289641 A1 10/2015 Ergun et al.
2018/0008037 A1 1/2018 Laudadio
2018/0140089 A1 * 5/2018 Blackburn ..... A47B 21/0314
2018/0255919 A1 9/2018 Swartz et al.
2019/0021487 A1 1/2019 Blackburn
2019/0116970 A1 * 4/2019 Lamb ..... A47B 3/0818
2019/0374024 A1 * 12/2019 Elliott ..... A47B 13/088
2022/0095787 A1 * 3/2022 Leng ..... A47B 3/002
2022/0257005 A1 * 8/2022 Kondel ..... A47B 13/081
2022/0279921 A1 * 9/2022 Harjula ..... A47B 9/02

* cited by examiner

MOVABLE DESK WITH ADJUSTABLE LIFT AND TILT

FIELD OF THE INVENTION

The invention relates to an electrically lifted and tilted computer desk and office desk thereof which can be used separately or in combination using a double-rail stem and can be lifted stably with low noise and great bearing power.

BACKGROUND OF THE INVENTION

With the generalization of digital homes and many companies participating in remote location work life, the household life of people are going through enormous changes, wherein the incorporation of digital automation design in modern homes is the outstanding advantage. In these household environments, the desk has become incorporated into human lives with multiple functions. Various drawbacks to existing adjustable height desks include the lack of variability in single angled desks which cannot be adjusted in height and angle to suit persons of various sizes, limited capabilities for storage and storing, and a general immobility of the desk apparatus itself (NAME) discloses such desktop device in order to solve the aforementioned problems.

Many companies are now allowing workers to work from home which results in a large change in the home to accommodate workers. Many workers are adjusting their home offices to incorporate digital automation design to improve their health and productivity. In these household work environments, the work desk has become incorporated into human lives with multiple functions. However, existing work desks have various drawbacks including the lack of range in the adjustable height and a lack of variability in desktop angle. These fixed angle desktops cannot be adjusted in both the desired height and angle over a wide range to suit people of various sizes, limited capabilities. These desks may also be large and difficult to store when the user is not working. What is needed is a design that is adjustable in both a wide range of lift and tilt angles that can also be configured to occupy a small area for storage.

SUMMARY OF THE INVENTION

An objective of the present invention to provide a desk which is capable of solving the limitations of other adjustable height desks. The inventive desk can both tilt and raise the desktop over a wide range of movements. In some embodiments, the desktop of the desk may tilt from 0 degrees (horizontal) to 60 degrees (angled downward) and a desktop height can be variable between 2 to 4.5 feet from the floor surface. With the desktop angled downward, the desk can occupy and be stored on less floor space than a desk with a horizontal desktop.

In an embodiment, the inventive desk can have: a desktop, tilt plates coupled to the desktop, and vertical members that support the desktop. The desktop can be moved vertically with vertical actuators and the angle of the desktop can be adjusted with tilt actuators. The vertical members can each have an elongated vertical groove and the tilt plates can each have bears that slide within the elongated vertical grooves. The bearings slide vertically within the grooves in the vertical members allowing the desktop to be smoothly lowered and raised with low friction. The bearings also allow the angle of the desktop can be smoothly adjusted with low friction.

The desk can also have an upper shelf unit that may be attached to the grooves of the vertical members above the desktop. In a first configuration, the upper shelf unit may move vertically with the desktop. In a second configuration, the upper shelf unit may be locked in place at a desired vertical position on the vertical members.

The desk may be stored easier by the desktop's ability to be angled downward at 45 degrees or more. At this lowered angle the desk occupies less floor area and therefore allows for more compact storage. The foregoing objectives, features, functions, and advantages of the present invention will be more readily understood upon a thoughtful deliberation of the following detailed description of the present invention with reference to the accompanying drawings.

DETAILED DESCRIPTION OF THE INVENTION

The invention relates to a desk that is adjustable to variable heights and desktop angles. In particular, the invention relates to an adjustable desk that can be moved between a sitting position and a standing position as well as being movable in tilt angle in the sitting and standing positions. Moreover, the invention relates to an adjustable desk that offers ease in height adjustment, desktop angle adjustment, movability, and storage, while also providing a user with an ergonomic work environment in order to improve the health and comfort of a user. Therefore, the invention has the advantages of stable lifting and tilting, and great powered movement.

Figure 1:
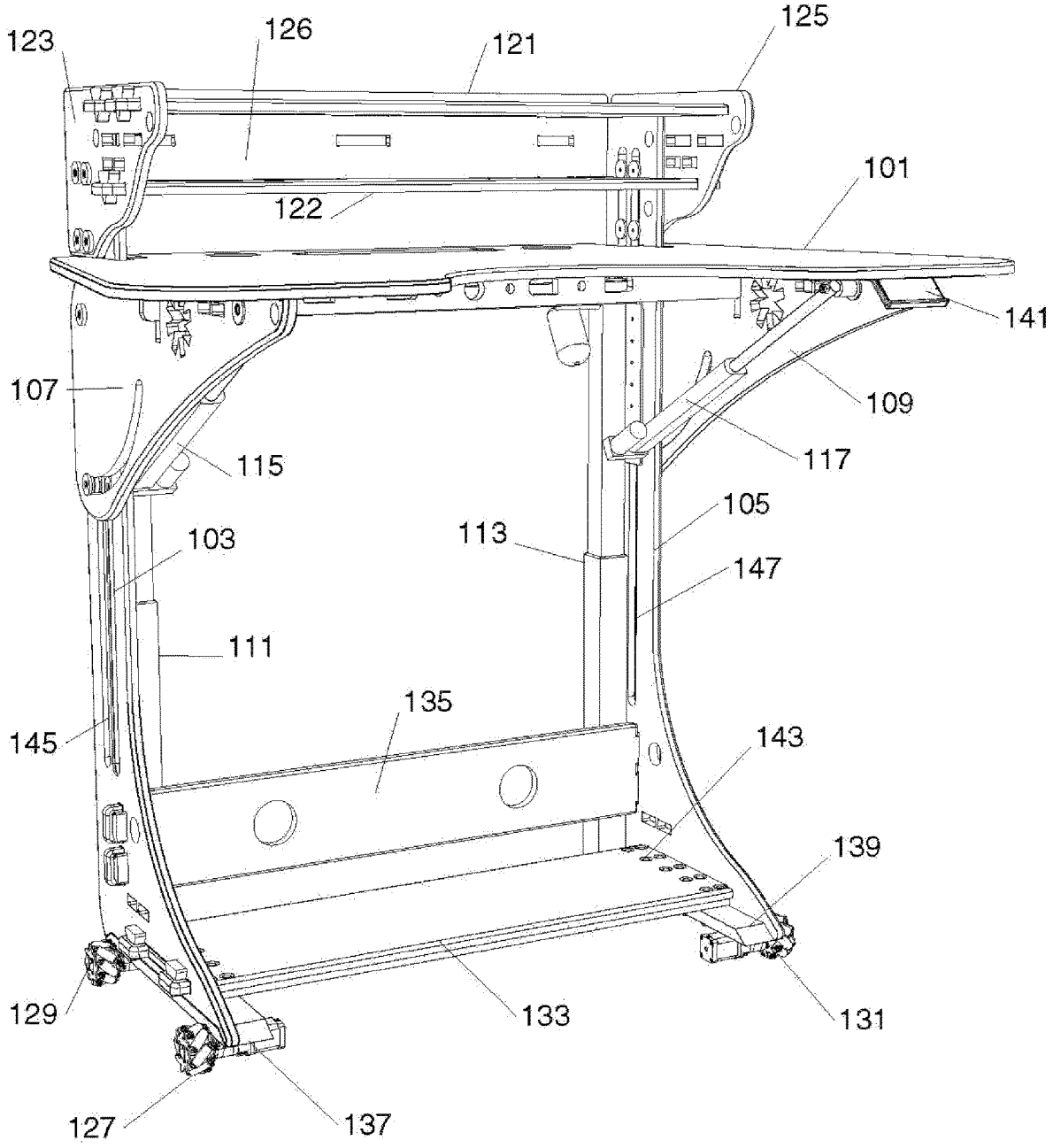
FIG. 1 is a front perspective view of an embodiment of the adjustable desk invention.

With reference to FIG. 1, an embodiment of the inventive desk 100 is illustrated. The inventive desk 100 comprises: an adjustable desk top 101, a first tilt plate 107, a second tilt plate 109, a first vertical member 103, a second vertical member 105, a first vertical actuator 111, a second vertical actuator 113, a first tilt actuator 115, and a second tilt actuator 117. The first vertical member 103 is coupled to the first tilt plate 107 at a first pivot point in first vertical member 151 on a rear portion of the first tilt plate 107 and the second vertical member 105 is coupled to the second tilt plate 109 on a rear portion of the second tilt plate 109. The first vertical actuator 111 is coupled to the first tilt plate 107 and the second vertical actuator 113 is coupled to the second tilt plate 109. The first vertical actuator 111 and the second vertical actuator 113 are extendable and retractable to move the first tilt plate 107, the second tilt plate 109, and the desk top 101 vertically. The first tilt actuator 115 is coupled to a front portion of the first tilt plate 107 and the second tilt actuator 117 coupled to a front portion of the second tilt plate 109. The first tilt actuator 115 and the second tilt actuator 117 are also extendable and retractable to change the tilt angle of the first tilt plate 107, the second tilt plate 109, and the desk top 101.

The first vertical actuator 111, the second vertical actuator 113, the first tilt actuator 115, and the second tilt actuator 117 can be coupled to a control unit 141 that can have a user interface. A user can input commands into the user interface so that the control unit 141 can control the movements of the first vertical actuator 111, the second vertical actuator 113, the first tilt actuator 115, and the second tilt actuator 117 which can cause the desktop 101 to move to the desired height and tilt angle.

In some embodiments, the desk 100 can have one or more planar shelves 121, 122. In the illustrated embodiment, an upper shelf assembly can have an upper shelf 121, a lower shelf 122, a first shelf side plate 123, a second shelf side plate 125 and an upper transverse member 126. The upper shelf assembly can be attached to the first vertical member 103 and the second vertical member 105. The upper shelf 121 and the lower shelf 122 can be planar structures that are horizontally oriented and extend across the width of the desk 100. The ends of the upper shelf 121 and the lower shelf 122 can be coupled between the first shelf side plate 123 and the second shelf side plate 125.

The bottoms of the first shelf side plate 123 and the second shelf side plate 125 can rest on a top surface of the desktop 101 and/or the first tilt plate 107 and the second tilt plate 109. In a first configuration, the upper shelf assembly can move vertically with the desk top 100 when the first vertical actuator 111 and the second vertical actuator 113 are extended or retracted. In a second configuration, a locking mechanism can be used to secure the upper shelf assembly to the first vertical member 103 and the second vertical member 105. Thus, the upper shelf assembly can remain in a fixed vertical position relative to the first vertical member 103 and the second vertical member 105 while the desk top 100 moves when the first vertical actuator 111 and the second vertical actuator 113 are extended or retracted.

In some embodiments, the desk 100 can have a bottom shelf 133 that can be mounted between the bottom portions of the first vertical member 103 and the second vertical member 105. The bottom shelf 133 can be a horizontally oriented planar structure. The lower portion of the desk 100 can also have a lower transverse member 135 that is planar and vertically oriented. The lower transverse member 135 can also be mounted between the bottom portions of the first vertical member 103 and the second vertical member 105.

In some embodiments, the desk 100 can have a plurality of wheels 127, 129, 131, 132 that allow the desk 100 to be easily moved across a floor. The wheels 127, 129, 131, 132 can be free rotating and locking so that the desk 100 can be manually moved to a desired position and then the wheels 127, 129, 131, 132 can be locked to prevent rotation so that the desk 100 remains in place. Alternatively, the wheels 127, 129, 131, 132 can be coupled to motors 137 that can be controlled by a control unit 141 to move the desk 100 to a desired location.

Figure 2:
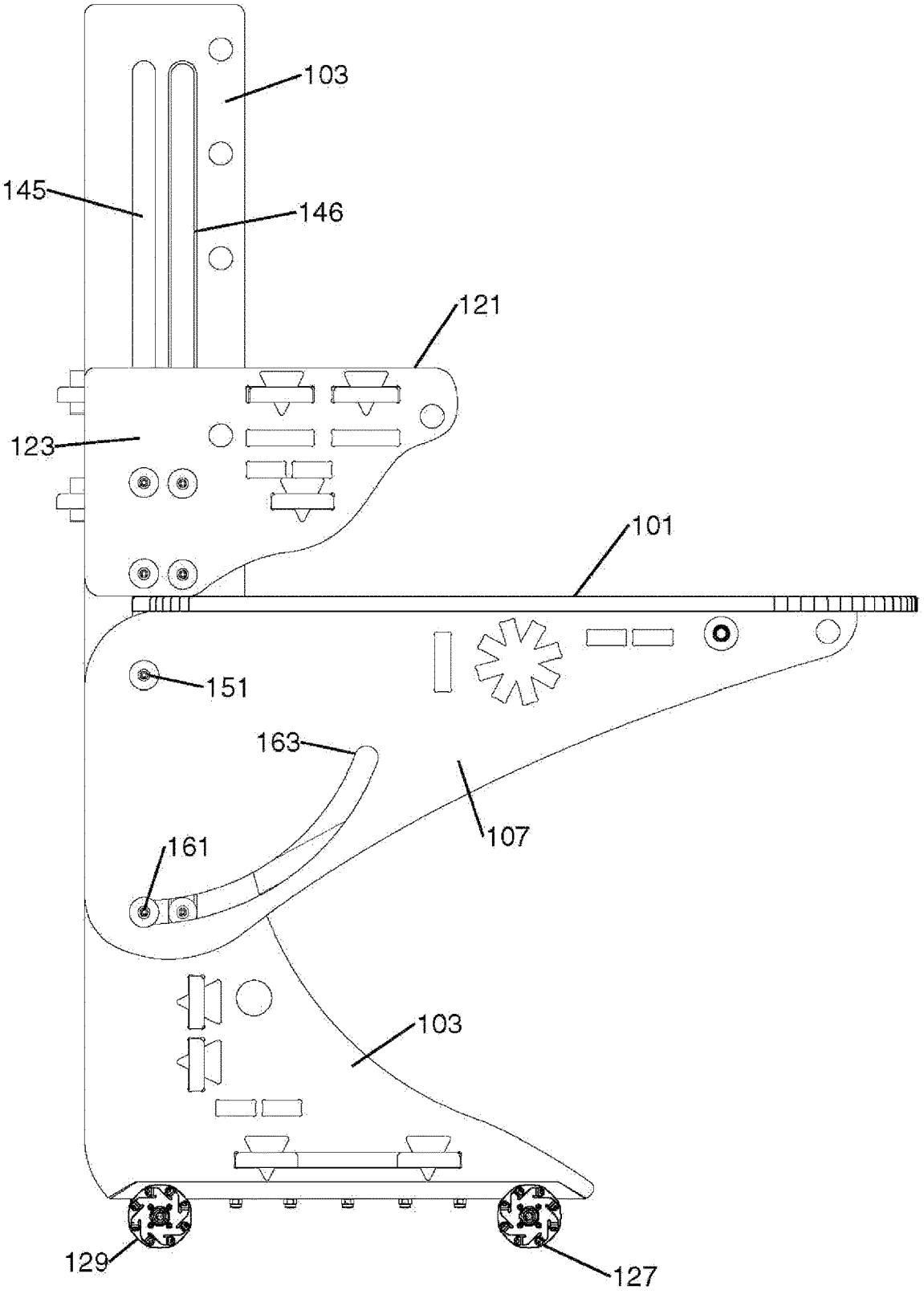
FIG. 2 is a left side view of an embodiment of the adjustable desk invention with the desktop in a horizontal and lowered position with the upper shelf assembly in a lowered position.

With reference to FIG. 2, a side view of an embodiment of the desk 100 with the desktop 101 in a horizontal lowered position is illustrated. In the illustrated embodiment, the vertical actuators have been retracted so that the desktop 101, first tilt plate 107, and the second tilt plate 109 are in a lowered position that may be suitable for seated work. The upper shelf assembly rests on the upper surface of the desktop 101 and has also moved to a lowered position. In different embodiments, the height of the desk top can be adjustable between 2 feet and 4.5 feet from the floor surface. In the illustrated lowered position, the height of the desktop can be 2 feet 5 inches.

The first vertical member 103 can have two vertical slots 145, 146. While the illustrated embodiment has two vertical slots, in other embodiments, the first vertical member 103 can have a single vertical slot 145.

As discussed, the first tilt plate 107 is coupled to the first vertical member 103. In the illustrated embodiment, a first pivot point in the first vertical member 151 and a first attachment point in vertical member 161 are used to couple the first tilt plate 107 to the first vertical member 103. The desktop 101 and the first tilt plate 107 can rotate about the first pivot point 151. Similarly, the desktop 101 and the second tilt plate can rotate about a second pivot point. The second tilt plate and the second pivot point are not shown in FIG. 2. When the desktop 101, first tilt plate 107, and second tilt plate rotate, the first attachment point 161 can slide within a first arcuate slot 163 and similarly a second attachment point can slide within a second arcuate slot on the right side of the desk.

Figure 3:
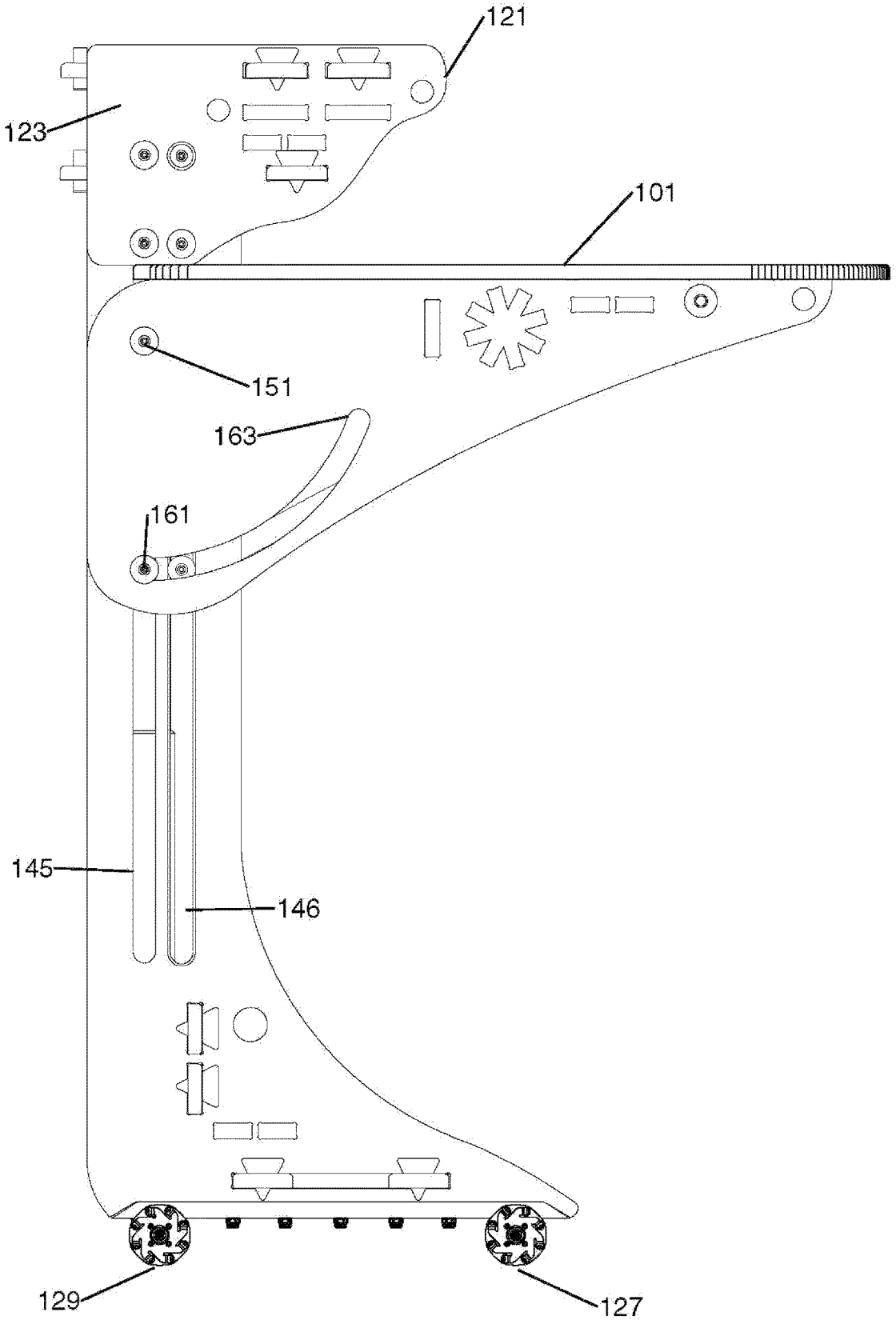
FIG. 3 is a left side view of an embodiment of the adjustable desk invention with the desktop in a horizontal and raised position.

FIG. 3 illustrates a side view of an embodiment of the desk 100 with the desktop 101 in a horizontal and raised or elevated position that may be suitable for standing work. In the illustrated embodiment, the vertical actuators have been extended so that the desktop 101, the first tilt plate 107, and the second tilt plate are in a raised position. The upper shelf assembly rests on the upper surface of the desktop 101 and is also in a raised position. In the illustrated raised position, the height of the desk can be 4 feet 1 inch.

In the illustrated raised position, the desk plate can be tilted from 0 to 60 degrees.

Figure 4:
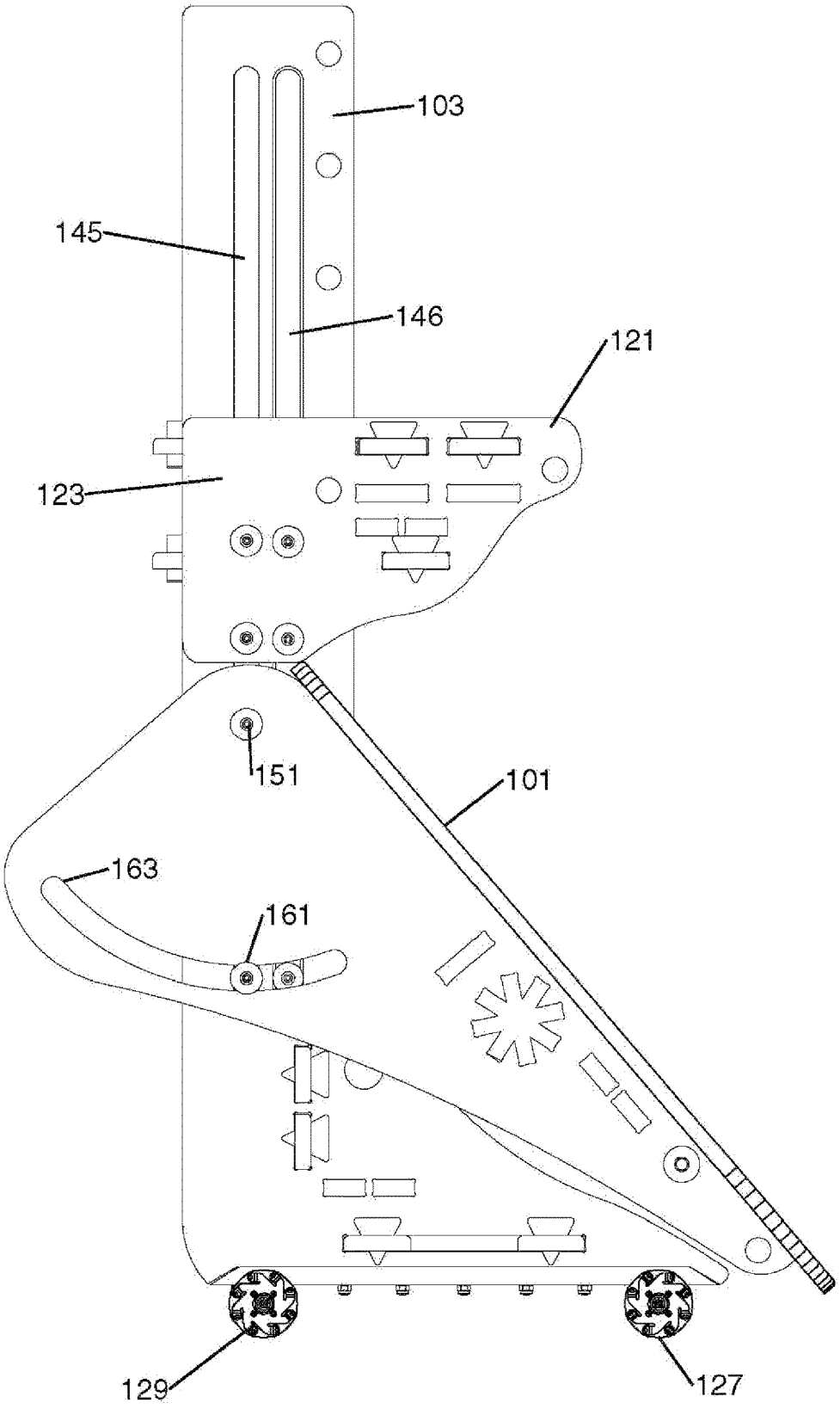
FIG. 4 is a left side view of an embodiment of the adjustable desk invention with the desktop in a tilted and lowered position.

With reference to FIG. 4, a side view of an embodiment of the desk 100 in a lowered and angled position is illustrated. In the illustrated embodiment, the vertical actuators have been retracted so that the desktop 101, first tilt plate 107, and the second tilt plate are in a lowered position. The first tilt actuator and the second tilt actuator have also been retracted so that the desktop 101, the first tilt plate 107, and the second tilt plate are also in a highly angled position. The upper shelf assembly can rest on the upper surface of the desktop 101 and/or rear portions of the first tilt plate 107, and the second tilt plate so that the upper shelf assembly is also in a lowered position. In this configuration, the desk 100 can occupy less horizontal space which can be useful for storage. In the illustrated lowered position, the desk plate can be tilted from 0 to 70 degrees.

Figure 5:
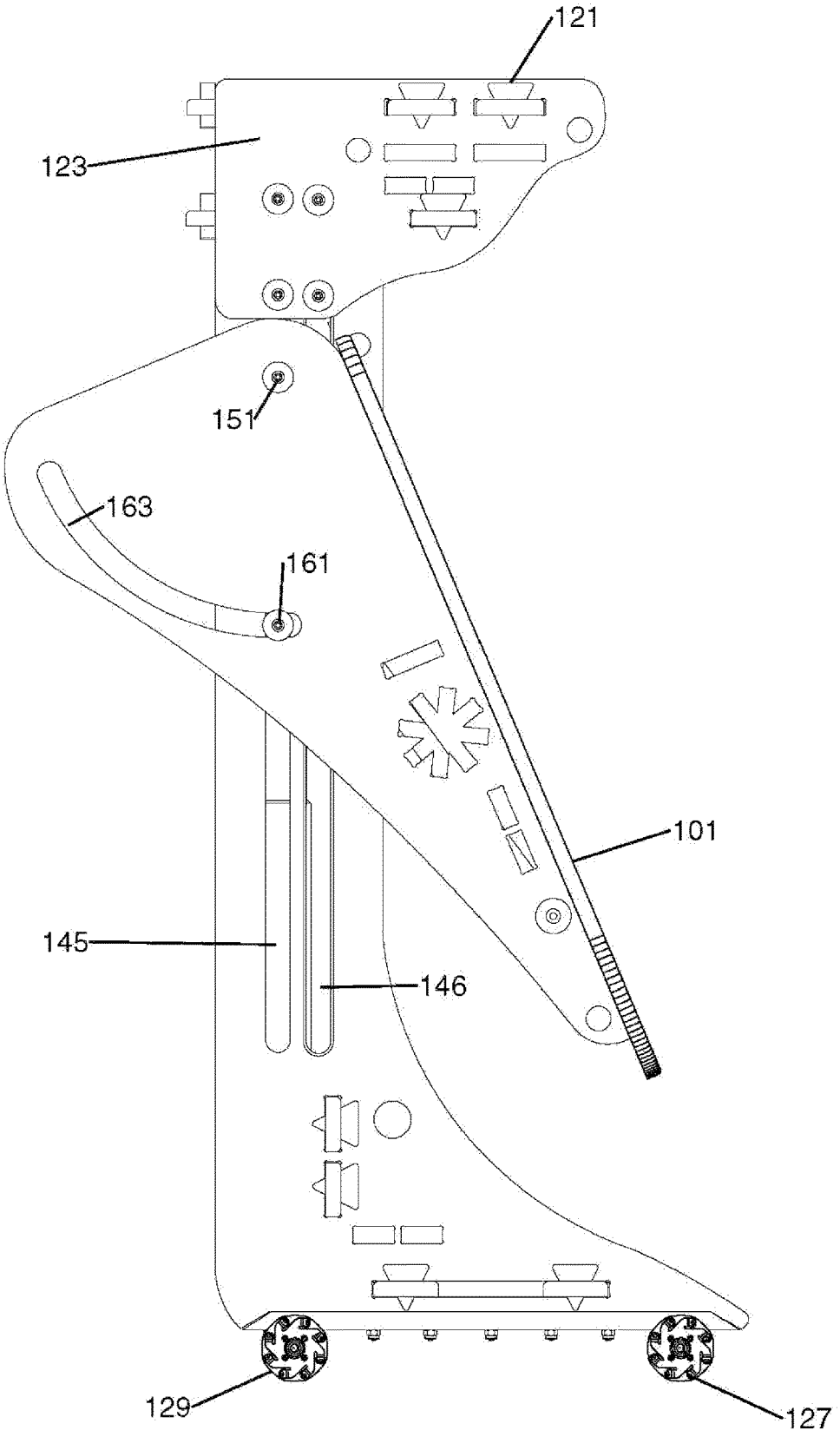
FIG. 5 is a left side view of an embodiment of the adjustable desk invention with the desktop in a tilted and raised position.

With reference to FIG. 5, a side view of an embodiment of the desk 100 in a raised angled position is illustrated. The illustration in FIG. 5 depicts the vertical actuators protracted so that the desktop 101, first tilt plate 107, and the second tilt plate are in a raised position. The first tilt actuator and the second tilt actuator are retracted so that the desktop 101, the first tilt plate 107, and the second tilt plate are in their maximum angled position. The upper shelf assembly rests on the upper surface of the desktop and/or rear portions of the first tilt plate 107, and the second tilt plate so that the upper shelf assembly is also in a raised position. This illustration shows the maximum height that the desktop 101 can be raised to. In this configuration, the desk 100 can occupy less space. In FIG. 5, the first tilt actuator and the second tilt actuator are retracted so that the desktop 101, the first tilt plate 107, and the second tilt plate are in a highly angled position which can be more angled than when the desktop 101 is at its lowest position. In the illustrated raised position, the tilt amble of the desktop 101 can be between Oto 60 degrees.

Figure 6:
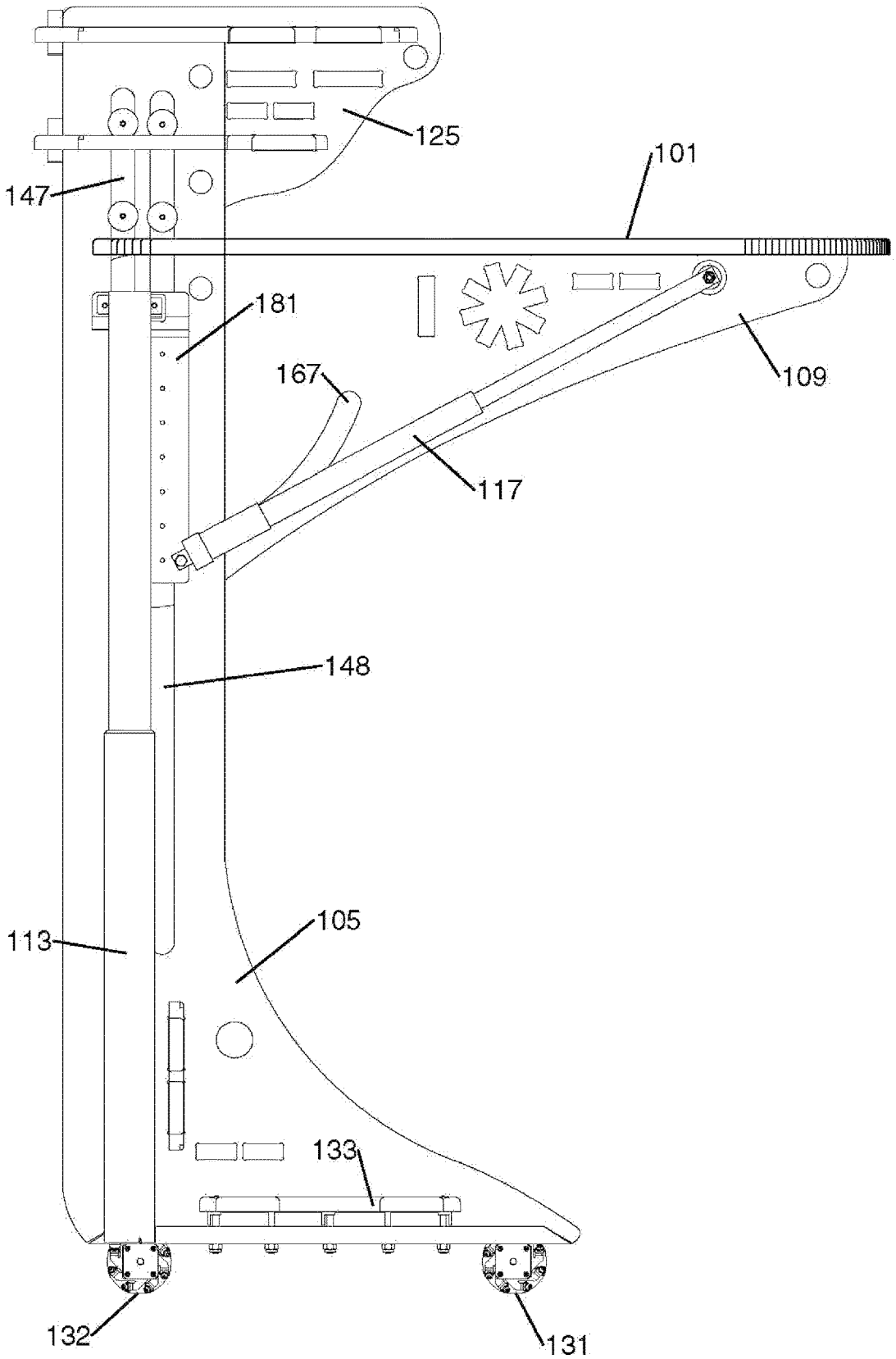
FIG. 6 is a left side view of a right inner portion of an embodiment of the adjustable desk invention with the desktop in a horizontal and raised position.

FIG. 6 is an inside view of the right portion of the desk 100 as shown in FIG. 3. FIG. 6 depicts the vertical actuators 113 as extended so that the desktop 101, first tilt plate (not shown) and the second tilt plate 109 are in a raised and horizontal position. In the illustrated raised position, the height of the desk can be 4 feet 1 inch. In the illustrated embodiment, the top portion of the second vertical actuator 113 is coupled to a second side plate 181. A plurality of bearings can extend from a planar surface of the second side plate 181. The bearings can be positioned within vertical parallel grooves 147, 148 in the first vertical member (not shown) and the second vertical member 105. The bearings allow the second side plate 181 and the second tilt plate 109 to move vertically with minimal friction. The second vertical actuator 113 can be positioned on a first side of the second side plate 181 and the bearings can extend outward from an opposite side of the second side plate 181. The bearings can each have an axis of rotation that is perpendicular to the plane of the second side plate 181. The bearings can also have a cylindrical portion adjacent to the second side plate 181 and a cap portion that has a wider diameter than the cylindrical portion. The cylindrical portion can have a diameter that is smaller than the width of the vertical grooves 147, 148 and the cap portion can have a diameter that is larger than the width of the vertical grooves 147, 148. When assembled the second side plate 181 can move the entire length of the vertical grooves 147, 148 but cannot be separated from the second vertical member 105. While the vertical members have been illustrated with two parallel grooves 147, 148, in other embodiments, the vertical members may each only have a single vertical groove within which the bearing slide.

The second tilt actuator 117 is coupled between a lower portion of the second side plate 181 and a front portion of the second tilt plate 109. These coupling points can be rotational couplings that allow the second tilt actuator 117 to rotate relative to the second side plate 181 and the second tilt plate 109. As the second tilt actuator 117 is retracted, a pivot cap (not shown) will slide within an arcuate slot 167.

Figure 7:
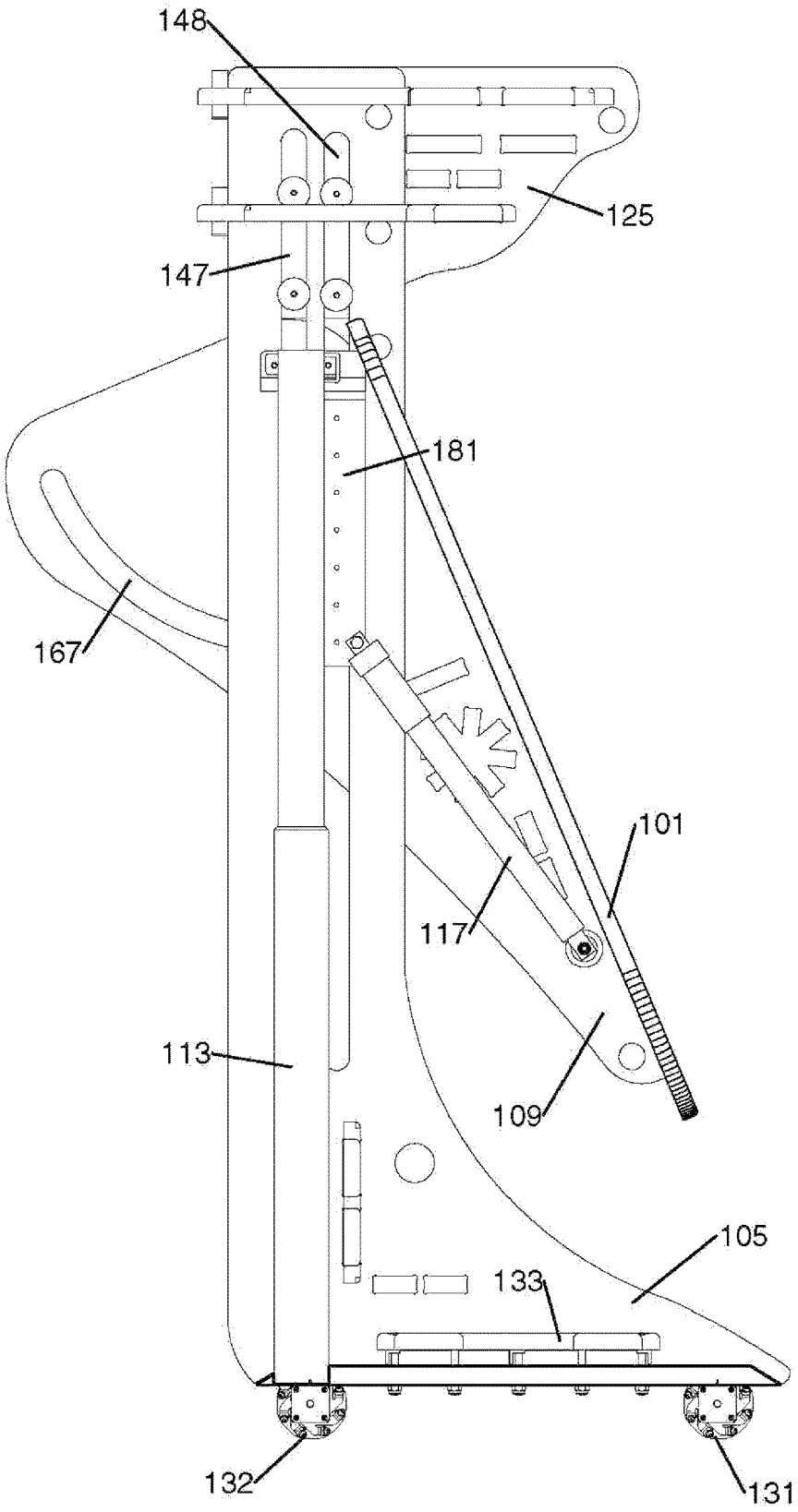
FIG. 7 is a left side view of a right inner portion of an embodiment of the adjustable desk invention with the desktop in a tilted and raised position.

FIG. 7 is an inside view of the second vertical member 105 depicting the tilt actuator 117 retracted so that the desktop 101 and the second tilt plate 109 are in a raised and angled position, as discussed in FIG. 5. The illustration shows the second tilt actuator 117 fully retracted so that the desktop 101, and the second tilt plate 109 are in their maximum angled positions. As discussed, the second tilt plate 109 rotates about a second pivot point and a lower rear portion of the second tilt plate 109 has been moved to extend back beyond a back edge of the second vertical member 105.

Figure 8:
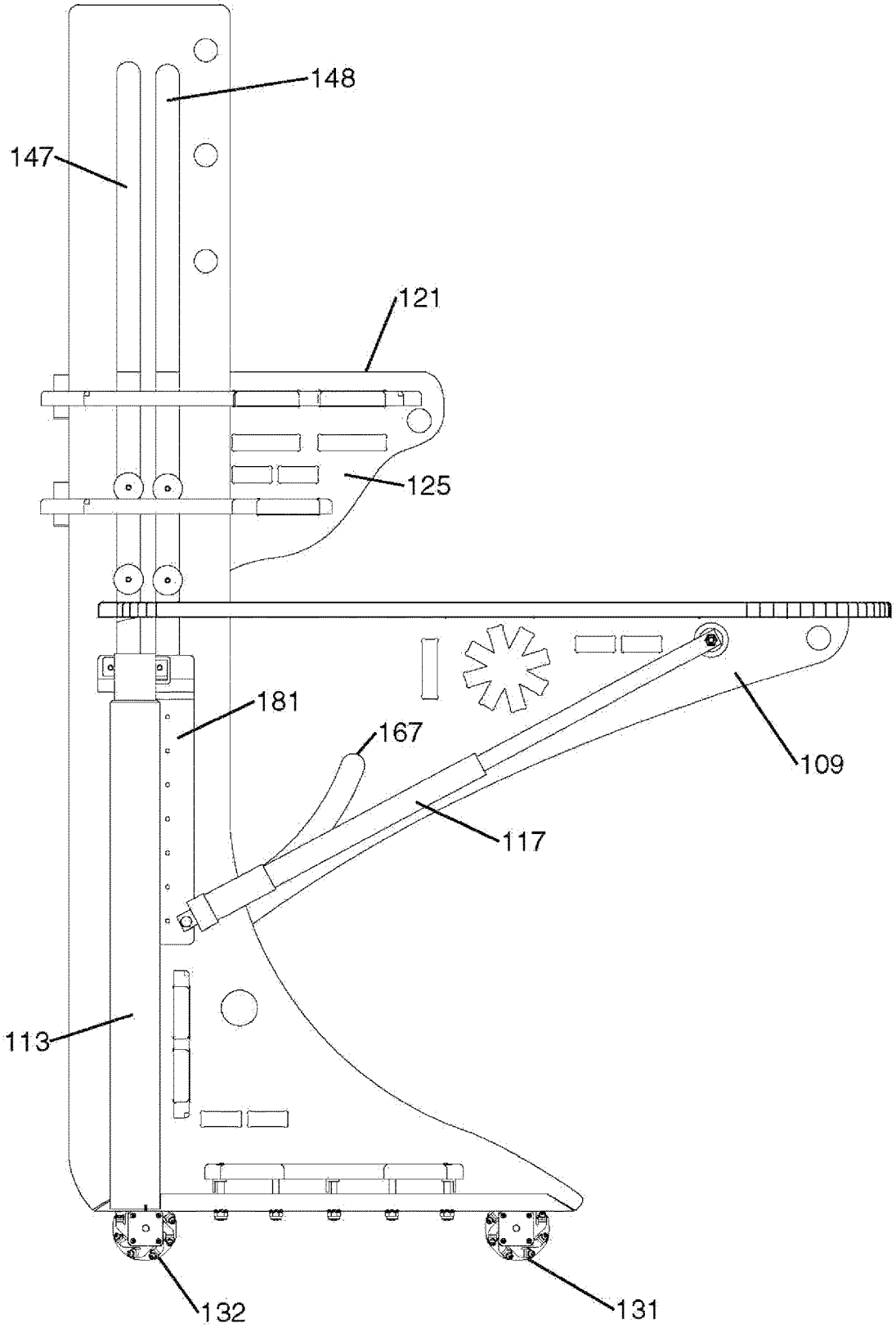
FIG. 8 is a left side view of a right inner portion of an embodiment of the adjustable desk invention with the desktop in a horizontal and lowered position.
Figure 9:
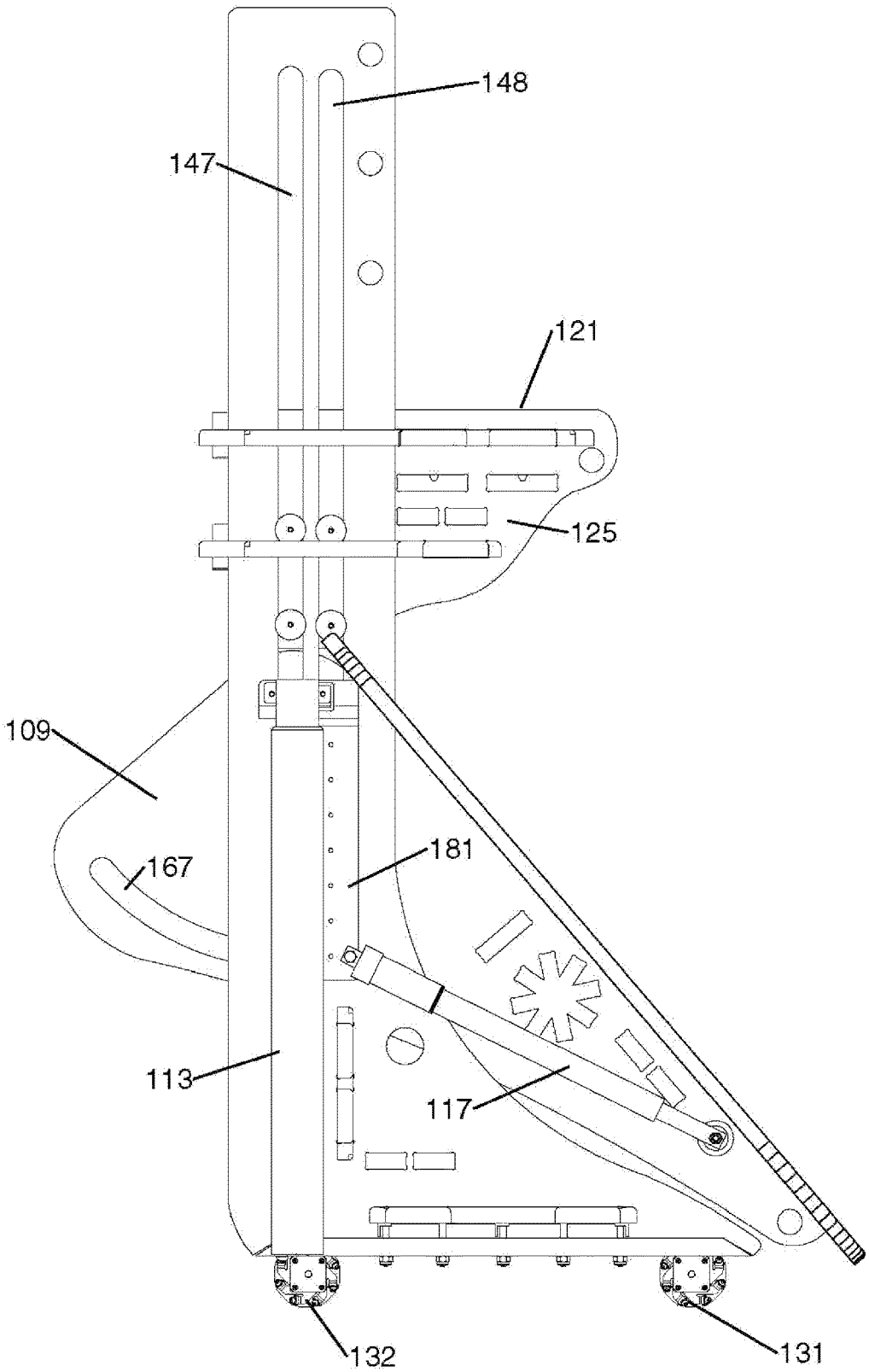
FIG. 9 is a left side view of a right inner portion of an embodiment of the adjustable desk invention with the desktop in a tilted and lowered position.

With reference to FIGS. 8 and 9, an inner right-side view of an embodiment of the desk 100 with the desktop 101 in the lowered position is illustrated. As discussed, the pivot points and the bearing attachment points slide within the vertical grooves 147, 148. In the illustrated embodiments, the vertical grooves 147, 148 is vertically oriented and therefore the pivot points and the attachment points can only move in vertical directions. Therefore when the vertical actuators 113 are fully retracted, the pivot points and the attachment points can slide to the bottom of the vertical grooves 147, 148. Conversely, when the vertical actuators are fully extended, the pivot points and the bearing attachment points can slide to an upper portion of the grooves 147, 148.

With reference to FIGS. 4-9, the upper shelf assembly can also be attached to the vertical slots 147, 148 in the vertical members 105. Bearings 185 can extend inward from the shelf slide plate 125 and allow the upper shelf assembly to smoothly slide up or down in a vertical direction. When the second vertical actuators 113 is fully extended, the shelf bearings 185 can slide to an upper end portion of the slots 147, 148 and when the second vertical actuators 113 is fully retracted, the shelf bearings 185 can slide to a lower portion of the slots 147, 148. In some embodiments, it may be desirable to lock the upper shelf assembly in a fixed position rather than having the shelf move with the desktop 101.

Figure 10:
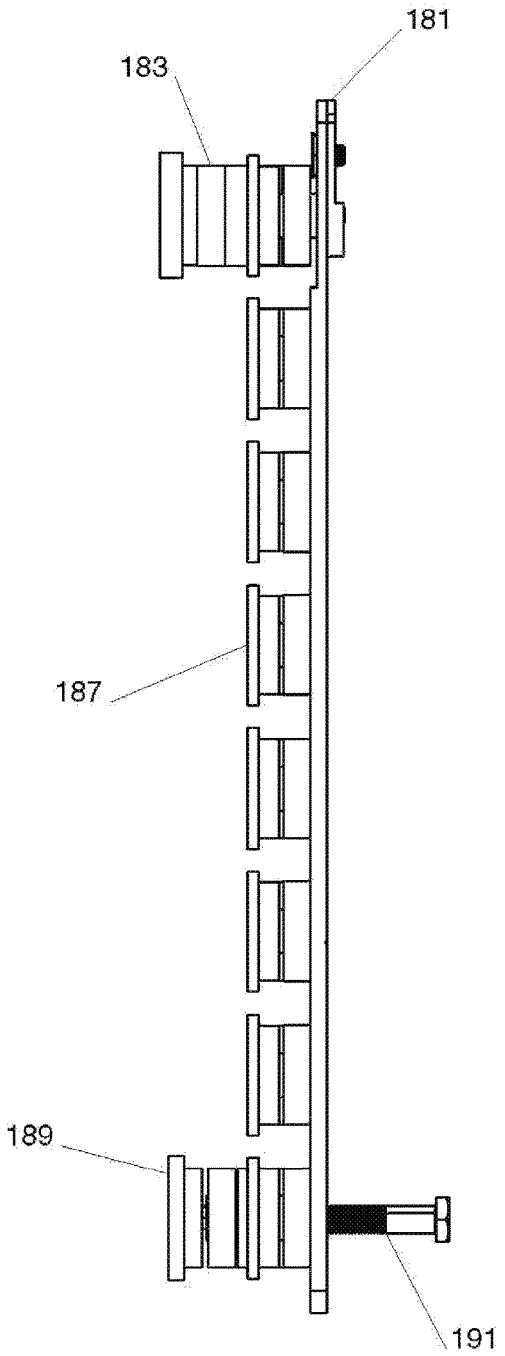
FIG. 10 is a side view of an embodiment of the plate assembly.
Figure 11:
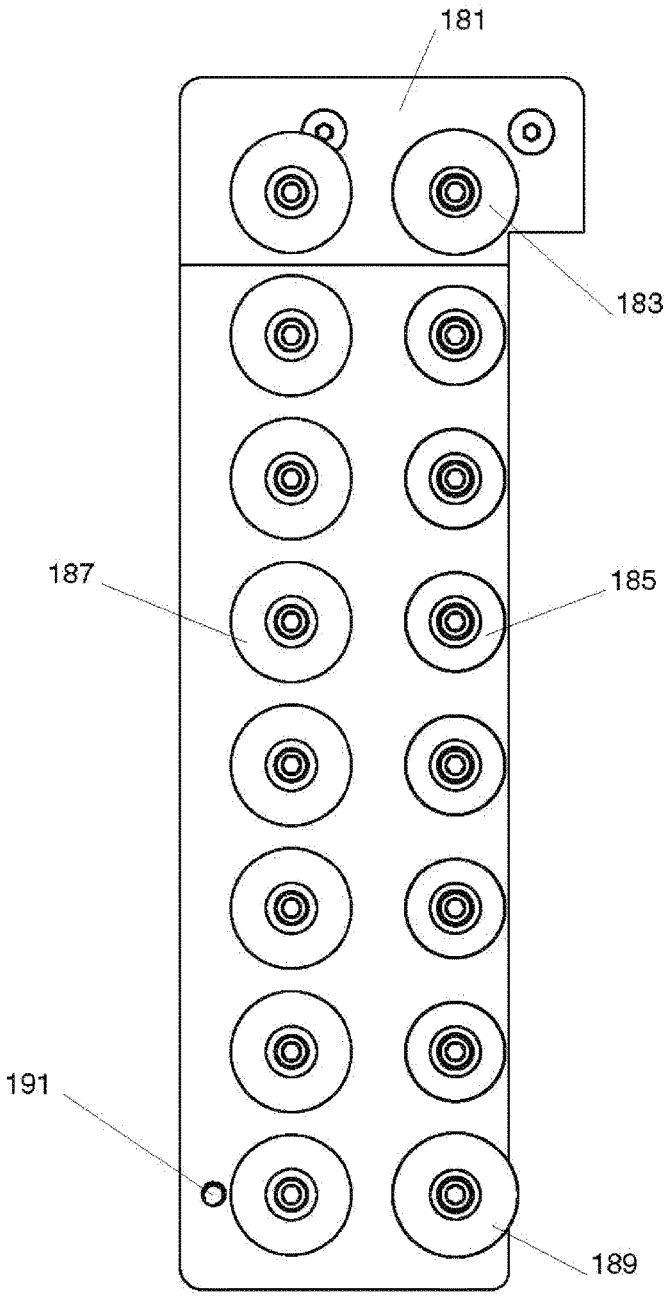
FIG. 11 is a front view of an embodiment of the plate assembly.
Figure 12:
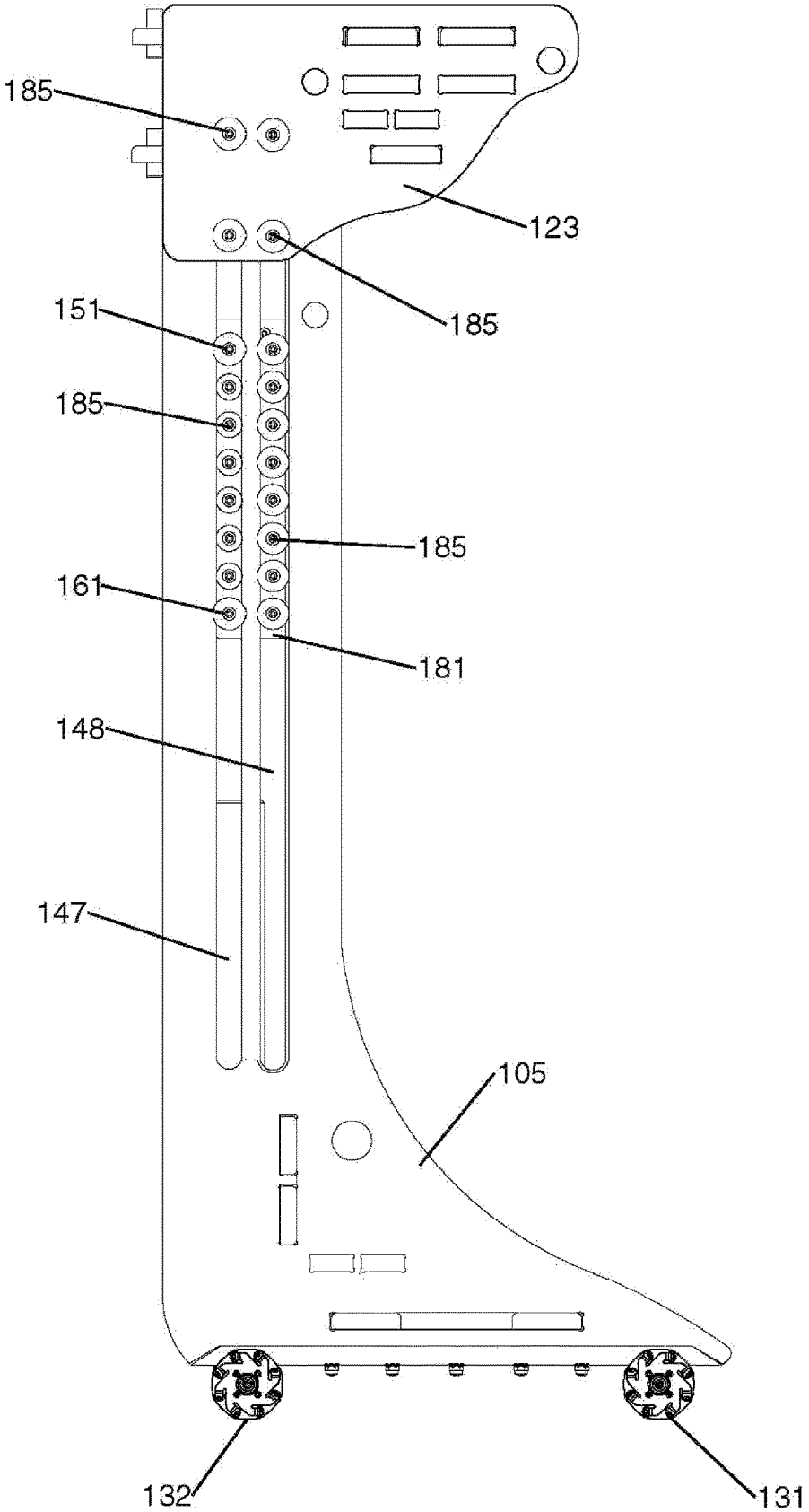
FIG. 12 is a side view of an embodiment of the adjustable desk invention with the desktop and the tilt plate removed.

FIG. 10 is a side view and FIG. 11 a front view of an embodiment of the double-rail system plate assembly 180, of the double-rail system plate assembly 180. In the illustrated embodiment, the double-rail system plate assembly 180 includes: a side plate 181, a pivot bearing 183, groove bearings 187, and an attachment bearing 189. FIG. 12, illustrates the vertical member 105 with the pivot bearing 183, groove bearings 187, and an attachment bearing 189 extending through the grooves 147, 148.

Each of the described pivot bearings 183, 187 is attached to the tilt plate shown in the other drawings. The pivot bearing 183 extends through the pivot point in the tilt plate and the attachment bearing 189 extends through the arcuate slot in the tilt plate. The weight of the desktop and the tilt plates is supported by the pivot bearings 183 and the attachment bearings 189. The pivot bearing 183, the groove bearings 187, and the attachment bearing 189 also extend through the vertical grooves in the vertical members. The vertical and tilt actuators are also attached to the side plate 181. The tilt actuator is coupled between a coupling on a front portion of the tilt plate and the tilt actuator pivot 191. In the tilt actuator's extended position, the desktop can be horizontal and in the retracted position, the desktop can be angled downward. As the tilt actuators move between extended and retracted positions, the tilt actuators can freely rotated about the coupling on the front portion of the tilt plate and the tilt actuator pivot 191. The upper end of vertical actuator is coupled to the upper coupling.

The pivot bearing 183, the groove bearings 187, and the attachment bearing 189 can be cylindrical in shape with a main portion that has a uniform diameter and an outer portion or middle portion that can have a wider diameter. These wider diameters can keep the pivot bearing 183, the groove bearings 187, and the attachment bearing 189 within the grooves 147, 148 or slots in the vertical member 105 and the tilt plates. The pivot bearing 183, the groove bearings 187, and the attachment bearing 189 can have smooth rolling bushings or bearings so that these components can slide smoothly within the grooves 147, 148 and slots of the vertical members and the tilt plates.

Figure 13:
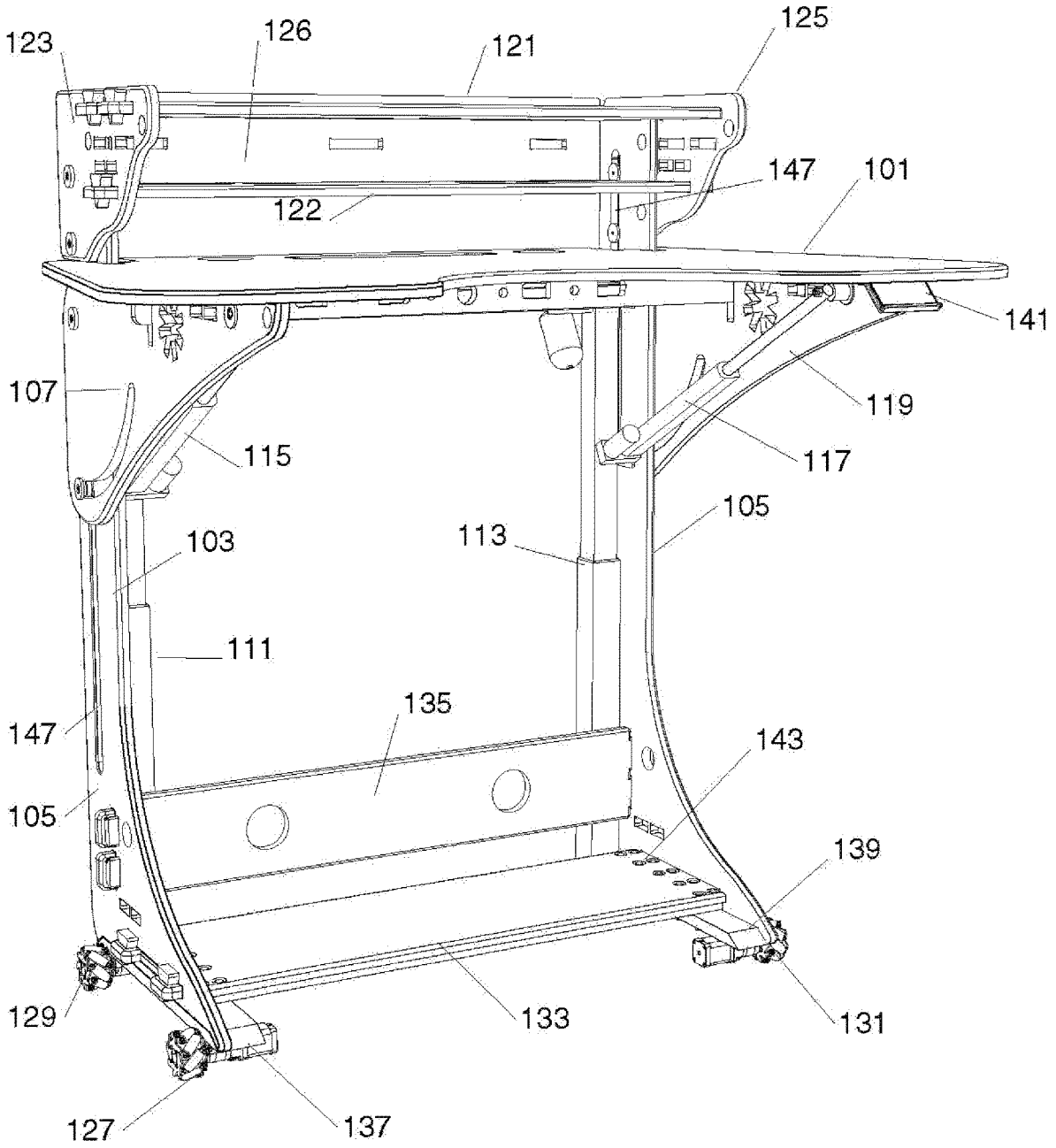
FIG. 13 is a front perspective view of an embodiment of the adjustable desk invention having a single groove in each vertical member.

With reference to FIG. 13, an embodiment of the inventive desk 100 is illustrated, similar to FIG. 1 but with only a first vertical slot in a first vertical member 105. As discussed, the pivot points and the bearing attachment points slide within the single vertical groove 147, 148. In the illustrated embodiments, the vertical grooves 147, 148 is vertically oriented and therefore the pivot points and the attachment points can only move in vertical directions.

Figure 14:
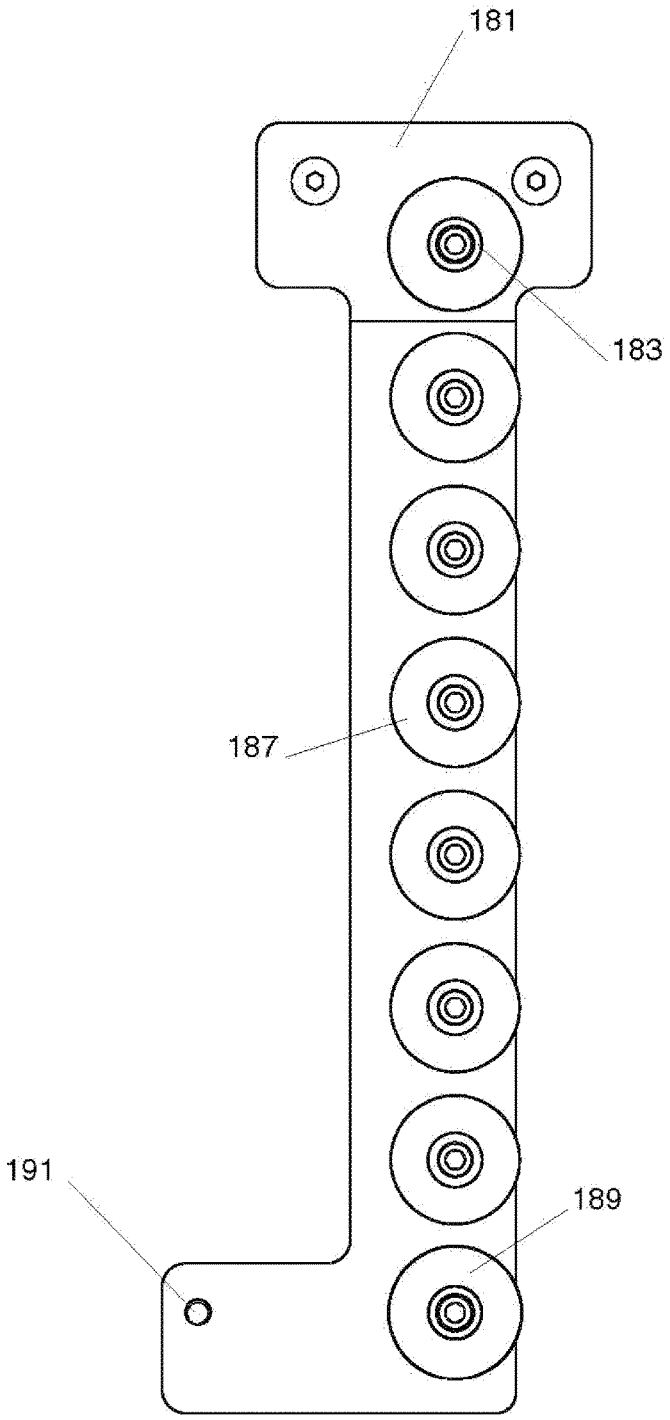
FIG. 14 is a front view of a single bearing row embodiment of the plate assembly.
Figure 15:
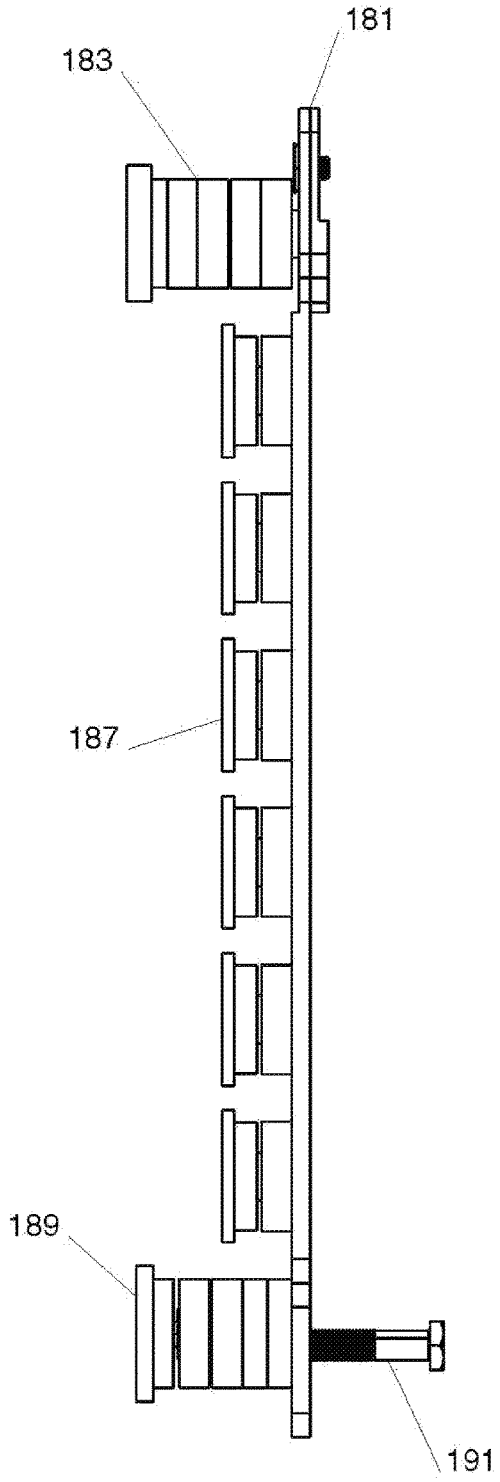
FIG. 15 is a side view of a single bearing row embodiment of the plate assembly.

FIG. 14 is a front view of an embodiment of the single-rail system plate assembly 180 to be used in the desk with only a first vertical slot in a first vertical member 105. FIG. 15 is a side view of an embodiment of the single-rail system plate assembly 180 to be used in the desk with only a first vertical slot in a first vertical member 105. The groove bearings 187 and the attachment bearing 189 extend through the vertical grooves in the vertical members. The vertical and tilt actuators are also attached to the side plate 181. The tilt actuator is coupled between a coupling on a front portion of the tilt plate and the tilt actuator pivot 191. In the tilt actuator's extended position, the desktop can be horizontal and in the retracted position, the desktop can be angled downward. As the tilt actuators move between extended and retracted positions, the tilt actuators can freely rotate about the coupling on the front portion of the tilt plate and the tilt actuator pivot 191.

Figure 16:
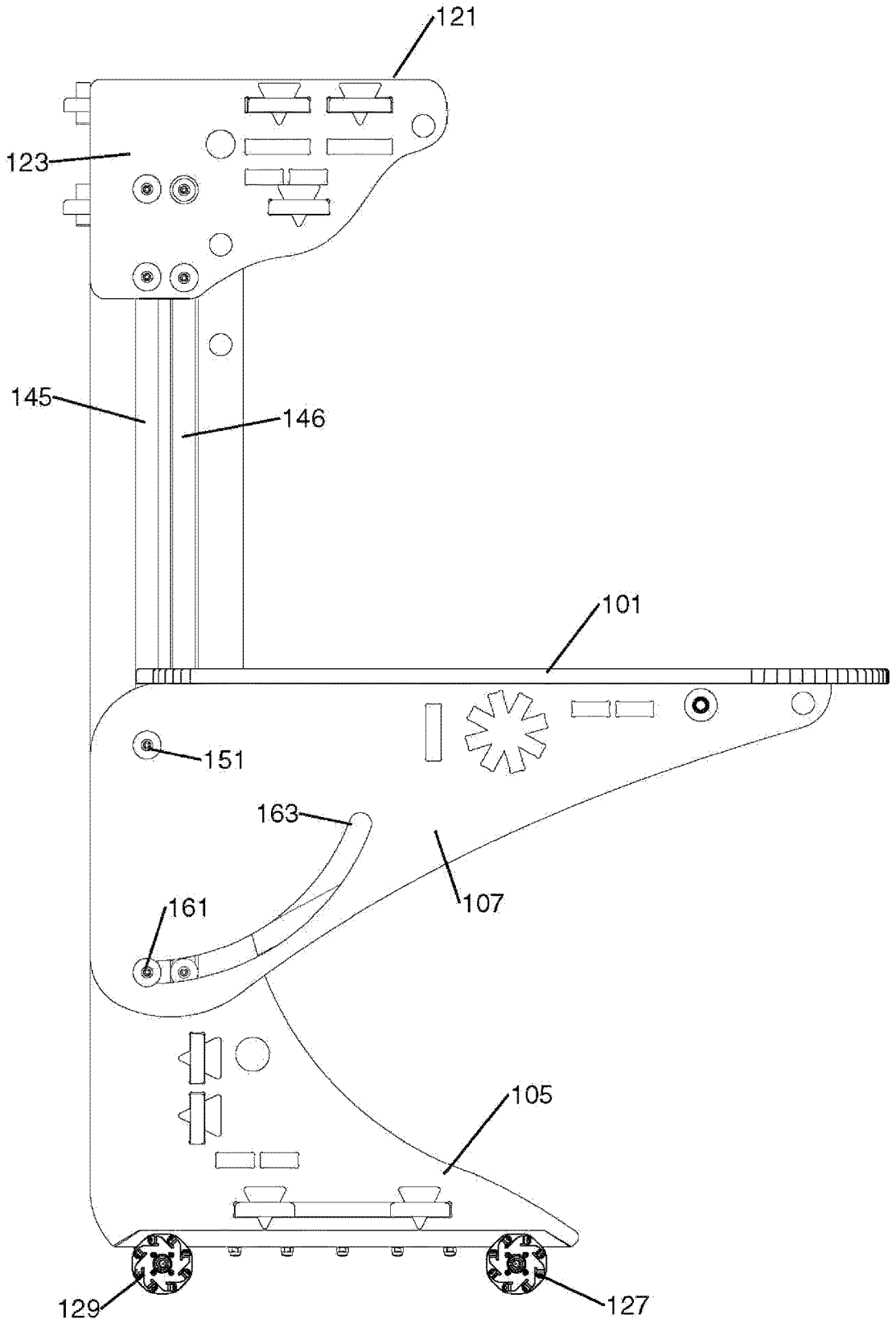
FIG. 16 is a left side view of an embodiment of the adjustable desk invention with the desktop in a horizontal and lowered position with the upper shelf assembly in a raised position.

FIG. 16 is a side view of an embodiment of the desk with the desktop 101 in a horizontal lowered position. The upper shelf assembly 121 can be locked in one of a plurality of raised positions at the upper portion of the vertical members. The upper shelf assembly 121 can be locked by a first bolt placed through a hole in the first shelf side plate 123 and a hole in the vertical member 105. As well as a second bolt placed through a hole in the second shelf side plate and a hole in the second vertical member. The vertical members can have a plurality of holes that can be used to adjust the position of the upper shelf assembly 121.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The present invention and some of its advantages have been described in detail for some embodiments. It should be understood that although the process is described with reference to a device, system, and method the process may be used in other contexts as well. It should also be understood that various changes, substitutions and alterations can be made herein without departing from the spirit and scope of the invention as defined by the appended claims. An embodiment of the invention may achieve multiple objectives, but not every embodiment falling within the scope of the attached claims will achieve every objective. Moreover, the scope of the present application is not intended to be limited to the particular embodiments of the process, machine, manufacture, composition of matter, means, methods and steps described in the specification. A person having ordinary skill in the art will readily appreciate from the disclosure of the present invention that processes, machines, manufacture, compositions of matter, means, methods, or steps, presently existing or later to be developed are equivalent to, and fall within the scope of, what is claimed. Accordingly, the appended claims are intended to include within their scope such processes, machines, manufacture, compositions of matter, means, methods, or steps

What is claimed is:

1. An adjustable desk comprising:
an adjustable desktop;
a first tilt plate coupled to the adjustable desk top;
a second tilt plate coupled to the adjustable desk top;
a first vertical member coupled to the first tilt plate at a first pivot point on a rear portion of the first tilt plate;
a second vertical member coupled to the second tilt plate at a second pivot point on a rear portion of the second tilt plate;
a first vertical actuator coupled to the first vertical member and the first tilt plate;
a second vertical actuator coupled to the second vertical member and the second tilt plate;
a first tilt actuator coupled to the first tilt plate configured to adjust a tilt angle of the desk top; and
a first side plate coupled to the first vertical actuator and the first tilt actuator, wherein the first side plate is adapted to move vertically along a length of the first vertical member.

2. The adjustable desk of claim 1 further comprising:
a second tilt actuator coupled to the second tilt plate; and
a second side plate coupled to the second vertical actuator and the second tilt actuator, wherein the second side plate is adapted to move vertically along a length of the second vertical member.

3. The adjustable desk of claim 1 wherein in a raised position, the desk top is adjustable between 0 and 67 degrees, and in a lowered position, the desk top is adjustable between 0 and 49 degrees.

4. The adjustable desk of claim 1 further comprising:
a first wheel and a first motor coupled to a bottom portion of the first vertical member;
a second wheel and a second motor coupled to the bottom portion of the first vertical member;
a third wheel and a third motor coupled to a bottom portion of the second vertical member;
a fourth wheel and a fourth motor coupled to the bottom portion of the second vertical member; and
a control unit coupled to the first motor, the second motor, the third motor, and the fourth motor for moving the adjustable desk to a predetermined location.

5. An adjustable desk comprising:
an adjustable desktop;
a first tilt plate coupled to the adjustable desk top;
a second tilt plate coupled to the adjustable desk top;
a first vertical member coupled to the first tilt plate;
a second vertical member coupled to the second tilt plate;
a first vertical actuator coupled to the first vertical member and the first tilt plate;
a second vertical actuator coupled to the second vertical member and the second tilt plate;

a first tilt actuator coupled to the first tilt plate;

a first vertical groove formed into the first vertical member;

a second vertical groove formed into the second vertical member; and a first side plate having first bearings, the first side plate coupled to the first vertical actuator and the first tilt actuator, wherein the first bearings are adapted to move vertically within the first vertical groove along a length of the first vertical member.

6. The adjustable desk of claim 5 further comprising:

a first center pivot bearing that is within the first vertical groove, the first vertical bearing coupled to the first tilt plate to provide support for the adjustable desk;

a second center pivot bearing that is within the second vertical groove, the second vertical bearing coupled to the second tilt plate to provide support for the adjustable desk;

a first lift plate coupled to the first vertical groove, the first lift plate coupled to the first vertical actuator; and a second lift plate coupled to the second vertical groove, the second lift plate coupled to the second vertical actuator;

a first bottom pivot coupled to the first lift plate wherein the first tilt actuator rotates about the first bottom pivot; and a second bottom pivot coupled to the second lift plate wherein the second tilt actuator rotates about the second bottom pivot.

7. The adjustable desk of claim 6 wherein the first bottom pivot is a first bearing having a first bottom pivot cap that has a first diameter that is greater than a first width of the first groove and the second bottom pivot is a second bearing having a second bottom pivot cap that has a second diameter that is greater than a second width of the second groove.

8. The adjustable desk of claim 6 wherein the first top pivot is a first bearing having a first top pivot cap that has a first diameter that is greater than a width of the first groove; and the second top pivot is a second bearing having a second bottom pivot cap that has a second diameter that is greater than a second width of the second groove.

9. The adjustable desk of claim 6 wherein the first vertical member and the second vertical member each have two parallel grooves with an identical length and width.

10. The adjustable desk of claim 6 wherein a plurality of bearings mounted on the first lift plate and the second lift plate wherein the axes of rotation are parallel.

11. The adjustable desk of claim 6 wherein the first vertical groove of the first vertical member and the second vertical groove of the second vertical member each have a length between 3 ft and 10 ft.

12. An adjustable desk comprising:

an adjustable desk top;

a first tilt plate coupled to the adjustable desk top;

a second tilt plate coupled to the adjustable desk top;

a first vertical member coupled to the first tilt plate;

a second vertical member coupled to the second tilt plate;

a first vertical actuator coupled to the first tilt plate;

a second vertical actuator coupled to the second tilt plate;

a first tilt actuator coupled to the first vertical actuator and coupled to the first tilt plate;

a first side plate coupled to the first vertical actuator and the first tilt actuator, wherein the first side plate is adapted to move vertically along a length of the first vertical member; and a second side plate coupled to the second vertical actuator and the second tilt actuator, wherein the second side plate is adapted to move vertically along a length of the second vertical member; and a top shelf assembly above the desktop and between the first vertical member and the second vertical member.

13. The adjustable desk of claim 12 further comprising:

a top shelf assembly coupled to the rear portion of the desktop, and a top shelf assembly that raises and lowers by means of two linear actuators coupled to the first and second vertical members.

14. The adjustable desk of claim 12 further comprising:

a top shelf assembly wherein the first shelf side plate has an orifice that allows for attachments of accessories.

15. The adjustable desk of claim 12 wherein in a raised position, the top shelf assembly is adjustable between 5 feet and 2 feet.

16. The adjustable desk of claim 12 wherein the top shelf assembly is coupled to the desktop by the first and second vertical grooves formed into the first and second vertical members.

17. The adjustable desk of claim 12 further comprising:

a first wheel and a first motor coupled to a bottom portion of the first vertical member;

a second wheel and a second motor coupled to the bottom portion of the first vertical member;

a third wheel and a third motor coupled to a bottom portion of the second vertical member;

a fourth wheel and a fourth motor coupled to the bottom portion of the second vertical member; and a control unit coupled to the first motor, the second motor, the third motor, and the fourth motor for moving the adjustable desk to a desired location.

* * * * *